United States Patent [19]

Oliver et al.

[11] Patent Number: 4,641,755

[45] Date of Patent: Feb. 10, 1987

[54] PROJECTILE STOWAGE RACK

[75] Inventors: Jim Oliver, Port Orchard; Pat Watson, Bremerton, both of Wash.

[73] Assignee: The United States of America as represented by the Secretary of the Navy, Washington, D.C.

[21] Appl. No.: 743,227

[22] Filed: Jun. 10, 1985

[51] Int. Cl.[4] ..... A47F 7/00

[52] U.S. Cl. ..... 211/60.1; 89/34; 206/3; 211/8; 211/59.4; 248/316.1

[58] Field of Search ..... 211/60.1, 70.4, 64, 211/59.4, 8, 4; 248/316.1, 313; 89/34; 206/3, 486, 488, 443, 446

[56] References Cited

U.S. PATENT DOCUMENTS

| | | | |
|---|---|---|---|
| 918,606 | 4/1909 | Stillwell | 206/3 |
| 1,047,366 | 12/1912 | Alston | 211/4 |
| 1,854,711 | 4/1932 | Mayer | 211/60.1 X |
| 2,412,729 | 12/1946 | Hall | 89/1.5 |
| 2,670,984 | 3/1954 | Arthur | 206/3 X |
| 2,766,660 | 10/1956 | Laddon et al. | 206/3 X |
| 2,822,730 | 2/1958 | Brennan et al. | 89/1 |
| 2,958,422 | 11/1960 | Caloiero et al. | 211/4 |
| 3,160,060 | 12/1964 | Zsoka et al. | 206/3 X |
| 3,165,205 | 1/1965 | Travis, Jr. | 211/60 |
| 3,166,196 | 1/1965 | Hereth et al. | 211/60 |
| 3,352,427 | 11/1967 | Lawrence | 248/313 X |
| 3,616,976 | 11/1971 | Geretschlaeger | 206/486 X |
| 3,643,813 | 2/1972 | Noonan | 248/313 X |
| 4,090,612 | 5/1978 | Lostutter | 211/60.1 X |
| 4,099,626 | 7/1978 | Magnussen, Jr. | 211/60 |
| 4,113,107 | 9/1978 | Jaeger | 211/64 |
| 4,125,052 | 11/1978 | Thomas | 248/313 X |
| 4,132,315 | 1/1979 | Young | 211/64 |
| 4,174,042 | 11/1979 | Fair | 211/64 |
| 4,195,732 | 4/1980 | Bell | 206/443 X |

FOREIGN PATENT DOCUMENTS

| | | | |
|---|---|---|---|
| 769956 | 10/1967 | Canada | 211/189 |
| 57181 | 6/1891 | Fed. Rep. of Germany | 206/3 |

*Primary Examiner*—J. Franklin Foss
*Assistant Examiner*—David L. Talbott
*Attorney, Agent, or Firm*—R. F. Beers; C. D. B. Curry

[57] ABSTRACT

A stowage rack unit consisting of a plurality of upright stanchions to provide a basic rack framework. The rack includes upper clamps and collars to restrict upward and horizontal motion of the projectiles. The collars have a two-piece threaded arrangement which allows adjustment to accommodate minor variations in projectile length. Lower clamps are provided for additional restraint against horizontal motion of the projectiles. Base plates are provided to support and restrict downward motion of the projectiles and side channels receive and secure the clamps and base plates. Additional special brackets are provided for attaching racks to bulkheads or for joining adjacent racks. To load the rack, side channels are attached to the stanchions and base plates are inserted into the lower pair of side channels and secured with pins. Individual upper and lower clamps are inserted into upper and middle side channels respectively and secured with pins. Projectiles are loaded vertically into receiving slots in the upper and lower clamps and an additional set of upper and lower clamps are inserted into their respective side channels and secured. The projectiles are locked in place by the two-piece collars which are secured by a quick release bolt. The process is repeated for each row of projectiles until the rack is completely loaded.

3 Claims, 6 Drawing Figures

PROJECTILE STOWAGE RACK

BACKGROUND OF THE INVENTION

1. Field of the Invention

This invention relates to projectile stowage and more particularly to a stowage rack that provides vertical stowage of projectiles to withstand high shock loads and is easily convertible to or from a rack for conventional stowage.

2. Description of the Prior Art

Projectiles are currently stowed bare and horizontally and while this is suitable for many uses it is not satisfactory where the projectile is long and horizontal space is at a premium. Moreover, horizontal stowage is not satisfactory where high shock is encountered. Of particular importance is the provision of a stowage rack that is safe, simple, and easy to quickly operate.

SUMMARY OF THE INVENTION

It is an object of the present invention to provide an improved stowage rack.

Another object of the present invention is to provide a stowage rack that stores projectiles in the vertical position and can withstand high shock forces.

A further object of the present invention is to provide a stowage rack that is safe, simple, and easy to quickly operate.

Other advantages and features will become apparent from the following description of the preferred embodiment when considered to conjunction with the accompanying drawings wherein:

DESCRIPTION OF THE PREFERRED EMBODIMENT

Figure 1:
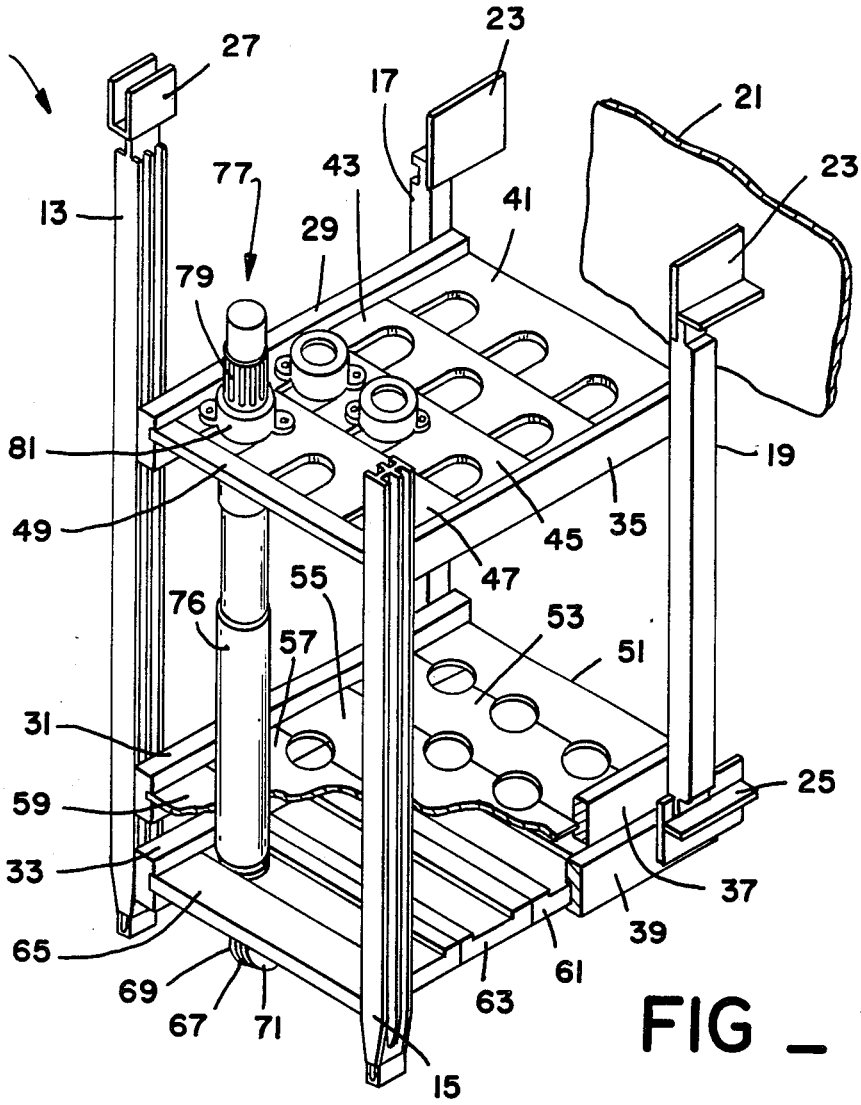
FIG. 1 is a pictorial view of the stowage rack of the present invention.
Figure 2:
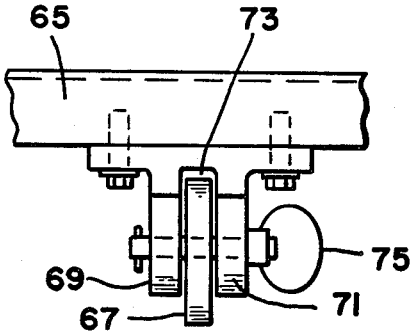
FIG. 2 is a side elevation of the base plate and support bar.

In FIG. 1 is shown a pictorial view of the stowage rack 11 of the present invention for storing projectiles, missiles or the like. The stowage rack includes two upright front stanchions 13 and 15 and two upright rear support members 17 and 19 that form the basic rack framework. These support members may be part of a conventional stowage system or they may be separate stanchions for use only with the hereinafter described stowage rack 11. Support members 17 and 19 are supported by the bulkhead 21 by means of upper brackets 23 and lower brackets 25. The lower end of each stanchion 13 and 15 rests against the deck and the upper end is retained in place by a bracket 27 that is attached to the compartment ceiling or the like. Attached to the stanchion 13 and support member 17 are upper side channel 29, middle side channel 31 and lower side channel 33. Attached to stanchion 15 and support member 19 are upper side channel 35, middle side channel 37 and lower side channel 39. Each of the side channels are mounted in the horizontal position and have interior horizontal slots. The slots in upper side channels 29 and 35 retain the ends of upper clamps 41, 43, 45 and 47 and upper clamp front bar 49. The slots in middle side channels 31 and 37 retain the ends of rear lower clamp 51, inner lower clamps 53, 55 and 57 and front lower clamp 59. The slots in lower side channels 33 and 39 retain the ends of the rear base plate, not shown, inner base plates 61 and 63 and front base plate 65. The four base plates are supported and retained in position by base plate support bar 67. As shown in FIG. 2 each base plate has a pair of spaced-apart downwardly extending members 69 and 71 that form a slot 73 into which support bar 67 is inserted. The support bar and base plates are retained in place by quick release pins 75.

Figure 5:
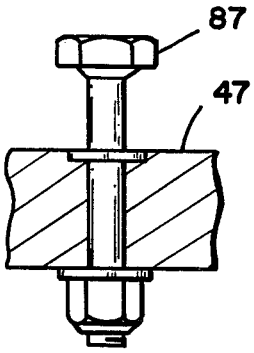
FIG. 5 is a side elevation of a quick release pin.
Figure 3:
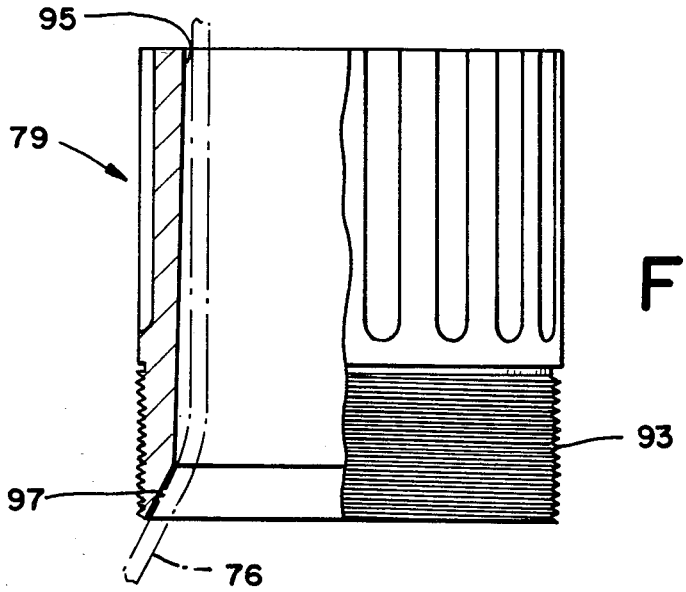
FIG. 3 is a side elevation of the top collar.
Figure 4A:
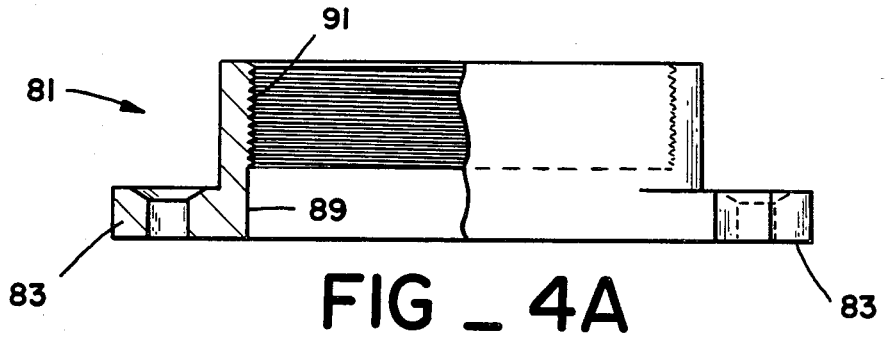
FIGS. 4A and 4B are the side and top elevations of the bottom collar.
Figure 4B:
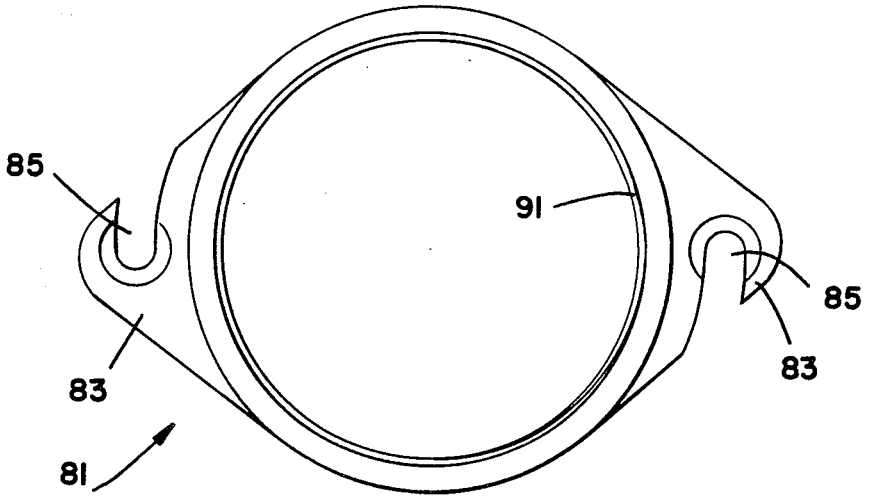

A plurality of projectiles 76 are retained in stowage rack 11 from vertical motion by means of adjustable collar assembly 77. As best shown in FIGS. 3, 4A and 4B each adjustable collar assembly 77 includes a top collar member 79 and a bottom collar member 81. The bottom collar member 81 has two lower flanges 83 that have slotted openings 85 for receiving bolts 87 as shown in FIG. 5. Bottom collar member 81 has a central opening 89 having female threads 91. Top collar member 79 includes mate threads 93, opening 95 and tapered flange 97. The projectiles 76 passes through opening 95 and its shoulder abuts flange 97 when assembled.

To load the stowage rack 11 the side channels 29, 31, 33, 35, 37 and 39 are attached to the stanchion 13 and 15 and support members 17 and 19 by removable bolts or the like. All base plates are positioned in the slots of lower side channels 33 and 39 and then retained in place by base plate support bar 67 and quick release pins 75. Then rear upper clamp 41 and rear lower clamp 51 are inserted in the slots of their respective side channels. Three projectiles are then positioned in their respective openings and rest on the slot formed in the rear base plate. Then the next inner upper clamp 43 and the inner lower clamp 53 are inserted in the slots of their respective side channels. Another three projectiles are then positioned in their respective openings and rest on the slot in the respective inner base plate. This process is repeated until all projectiles are in place. The upper clamp front bar 49 is attached to retain the upper end of the last three projectiles. All of the upper and lower clamps are preferably held in place by quick release pins that connect to the respective side channels. The next step is to attach each adjustable collar assembly by rotating bottom collar 81 to engage bolts 87 and then screwing top collar 79 onto the bottom collar 81 until it becomes tight due to engagement with the projectile. Depending upon ship movement it may be desirable to attach the collar assemblies after each set of three projectiles have been loaded. To remove projectiles the above described process is reversed. All of the stowage rack may be easily removed leaving support members 17 and 19 which form the foundation of support for conventional projectile stowage.

What is claimed is:

1. A stowage rack comprising:

(a) two pairs of vertical support members;

(b) a plurality of side channels connected to respective pairs of said vertical support members, said plurality of side channels including a pair of upper side channels, a pair of middle side channels, and a pair of lower side channels;

(c) a plurality of upper clamps and lower clamps engaging said side channels, said upper clamps and said lower clamps including openings for receiving vertically extending objects such as projectiles;

(d) a plurality of base plates engaging said side channels, said base plates supporting the lower end of said vertically extending objects and including slots for receiving the lower end of said vertically extending objects;

(f) each of said pairs of side channels having a slot for receiving the ends of said upper clamps, said lower clamps and said base plates; and (g) an adjustable collar engaging the upper end of each vertically extending object and said upper clamps to retain said vertically extending object in fixed position, said adjustable collar including a bottom collar and a top collar wherein said bottom collar engages said upper clamp and said top collar engages said object.

2. The stowage rack of claim 1 wherein:

(a) said bottom collar has female threads and two flanges and two slots respectively in each of said flanges for engaging with bolts mounted in said upper clamps.

3. The stowage rack of claim 2 wherein:

(a) said top collar includes male threads and a tapered flange, said male threads engaging said female threads of said bottom collar and said tapered flange engaging said vertically extending object.

* * * * *